US010219573B2

(12) United States Patent
Podboy

(10) Patent No.: US 10,219,573 B2
(45) Date of Patent: Mar. 5, 2019

(54) HELMET TO REDUCE TRAUMATIC BRAIN INJURIES

(71) Applicant: Ronald A. Podboy, Denver, CO (US)

(72) Inventor: Ronald A. Podboy, Denver, CO (US)

( * ) Notice: Subject to any disclaimer, the term of this patent is extended or adjusted under 35 U.S.C. 154(b) by 279 days.

(21) Appl. No.: 14/993,989

(22) Filed: Jan. 12, 2016

(65) Prior Publication Data

US 2017/0196293 A1 Jul. 13, 2017

(51) Int. Cl.

| | |
|---|---|
| ***A42B 3/20*** | (2006.01) |
| ***A42B 3/12*** | (2006.01) |
| ***A42B 3/04*** | (2006.01) |
| ***A42B 3/14*** | (2006.01) |
| ***A42B 3/28*** | (2006.01) |

(52) U.S. Cl.

CPC ..... *A42B 3/122* (2013.01); *A42B 3/0453* (2013.01); *A42B 3/142* (2013.01); *A42B 3/20* (2013.01); *A42B 3/283* (2013.01)

(58) Field of Classification Search

CPC ..... A42B 3/122; A42B 3/0453; A42B 3/142; A42B 3/20; A42B 3/283

See application file for complete search history.

(56) References Cited

U.S. PATENT DOCUMENTS

| | | | |
|---|---|---|---|
| 2,150,290 | A | 3/1939 | Mulvey |
| 2,194,903 | A | 3/1940 | Holstein |
| 2,759,186 | A | 6/1965 | Dye |
| 3,186,004 | A | 6/1965 | Carlini |
| 3,787,893 | A | 1/1974 | Larcher |
| 4,035,846 | A | 7/1977 | Jencks |
| 4,324,005 | A | 4/1982 | Willis |
| 4,566,137 | A | 1/1986 | Gooding |
| 5,014,365 | A | 5/1991 | Schulz |

(Continued)

FOREIGN PATENT DOCUMENTS

| | | |
|---|---|---|
| CN | 202233229 | 5/2012 |
| FR | 2915852 | 11/2008 |

OTHER PUBLICATIONS

"Adams Elite Air Bladder Sealing Valves," Epic Sports, Inc., retrieved from http://football.epicsports.com/prod/22483/index.html, retrieved on Jun. 1, 2016, 2 pages.

(Continued)

*Primary Examiner* — Andrew W Sutton

(74) *Attorney, Agent, or Firm* — Berg Hill Greenleaf Ruscitti LLC

(57) ABSTRACT

A protective helmet includes a plurality of fluid filled bladders, impact sensors, valves, and pumps wherein the helmet absorbs energy from an impact to protect a person wearing the helmet from traumatic brain injury. The bladders expel fluid in response to a triggering event such as energy from an impact detected as a pressure spike event and/or detected as an acceleration event. A selected bladder may expel fluid to other bladders, to a reservoir, to the environment outside of the protective helmet, or combinations thereof. In embodiments where the bladders need additional fluid after an impact, one or more pumps may refill selected deflated bladders. When a bladder is underinflated, an indicator light may emit light on an outer surface of the protective helmet to warn that the bladder is not yet ready to be placed in operation to absorb another impact.

13 Claims, 9 Drawing Sheets

(56) References Cited

U.S. PATENT DOCUMENTS

| | | | | |
|---|---|---|---|---|
| D318,747 | S | 7/1991 | Barker | |
| 5,083,320 | A | 1/1992 | Halstead | |
| 5,129,107 | A | 7/1992 | Lorenzo | |
| 5,175,889 | A | 1/1993 | Infusino | |
| 5,181,279 | A | 1/1993 | Ross | |
| D338,546 | S | 8/1993 | Barker | |
| 5,259,071 | A | 11/1993 | Scott et al. | |
| 5,263,203 | A | 11/1993 | Kraemer et al. | |
| 5,337,420 | A | 8/1994 | Haysom et al. | |
| D352,333 | S | 11/1994 | Lieberman | |
| 5,720,051 | A | 2/1998 | Johnson | |
| 5,987,779 | A | 11/1999 | Litchfield et al. | |
| 6,154,889 | A | 12/2000 | Moore, III et al. | |
| 6,226,801 | B1 | 5/2001 | Alexander et al. | |
| 6,591,428 | B2 | 7/2003 | Halstead et al. | |
| 6,681,408 | B2 | 1/2004 | Ku | |
| 6,934,971 | B2 | 8/2005 | Ide et al. | |
| 7,328,462 | B1 | 2/2008 | Straus | |
| 8,046,845 | B1 | 11/2011 | Garcia et al. | |
| 8,336,122 | B1 | 12/2012 | Harris | |
| 8,544,117 | B2 | 10/2013 | Erb et al. | |
| 8,566,969 | B2 | 10/2013 | Glogowski et al. | |
| 8,590,063 | B2 | 11/2013 | Aulenbach | |
| 8,813,269 | B2 | 8/2014 | Bologna et al. | |
| 8,881,315 | B2 | 11/2014 | Desjardins et al. | |
| 9,007,217 | B1 * | 4/2015 | Anvari | H04B 1/385 340/540 |
| 9,075,405 | B1 * | 7/2015 | Anvari | G05B 13/02 |
| 9,107,644 | B2 * | 8/2015 | Frix | A61B 5/02416 |
| 9,339,236 | B2 * | 5/2016 | Frix | A61B 5/14552 |
| 9,615,797 | B2 * | 4/2017 | John | A61B 5/1117 |
| 9,661,890 | B2 * | 5/2017 | Weatherby | A63B 71/081 |
| 9,730,482 | B2 * | 8/2017 | Allen | A42B 3/0486 |
| 9,788,588 | B2 * | 10/2017 | Allen | A42B 3/0486 |
| 2003/0135914 | A1 | 7/2003 | Racine et al. | |
| 2012/0304367 | A1 | 12/2012 | Howard et al. | |
| 2013/0174331 | A1 | 7/2013 | Witcher | |
| 2013/0232667 | A1 | 9/2013 | Leon | |
| 2013/0247285 | A1 | 9/2013 | Bartsch et al. | |
| 2013/0283506 | A1 | 10/2013 | Archbold | |
| 2014/0000011 | A1 * | 1/2014 | Johnson | A42B 3/121 2/413 |
| 2014/0033402 | A1 | 2/2014 | Donnadieu et al. | |
| 2014/0068841 | A1 | 3/2014 | Brown | |
| 2014/0201890 | A1 | 7/2014 | Kelly et al. | |

OTHER PUBLICATIONS

"D30 Unveils High Performance Helmet System Prototype," 2014, retrieved from https://web.archive.org/web/20140906150044/http://www.d3o.com/2014/06/d3o-unveils-high-performance-helmet-system-prototype/, retrieved on Jun. 1, 2016, 3 pages.

"STX and Schutt Join Forces to Revolutionize the Lacrosse Helmet Market," PRWeb, 2014, retrieved from http://www.prweb.com/releases/STX/LacrosseHelmet/prwebl2332044.htm, retrieved on May 31, 2016, 4 pages.

"Scorpion Sports VX-R70 Helmet," VITALMX, 2015, retrieved from https://web.archive.org/web/20150910164358/http://www.vitalmx.com/prduct/guide/Helmets,24/ Scorpion-Sports/VX-R70,8968, retrieved on Jun. 1, 2016, 7 pages.

Olson, "Engineers improving football helmets for safety," 2012, retrieved from http://g34olson.blogspot.com/2012/10/engineers-improving-football-helmets.html, retrieved on May 31, 2016, 3 pages.

"Riddell Revo/RevoIQ Crown Bladder," Football America UK, 2015, retrieved from https://web.archive.org/web/20151029052223/http://www.footballamerica.co.uk/shop/helmet-pumps-bladders-jaw-pads-and-spares/267-riddell-revorevo-iq-crown-bladder.html, retrieved on Jun. 1, 2016, 2 pages.

* cited by examiner

HELMET TO REDUCE TRAUMATIC BRAIN INJURIES

FIELD OF THE INVENTION

The invention relates generally to protective gear including helmets, and more particularly to protective helmets especially adapted for sporting events such as football, lacrosse, hockey and baseball, wherein the protective helmet is designed to reduce traumatic brain injuries.

BACKGROUND OF THE INVENTION

Contact sports, such as football, require the use of helmets to protect players from head injuries caused by impact forces sustained during games or practice. In recent years, a degenerative disease known as chronic traumatic encephalopathy (CTE) has been diagnosed in many retired players of contact sports. While the scientific analysis and characterization of CTE is ongoing, cumulative concussions are believed to cause the physical manifestations of CTE including atrophy of certain regions of the brain. Even numerous sub-concussive events are thought to contribute to CTE. For example, collisions between defensive and offensive linemen in football rarely render players completely unconscious, but numerous sub-concussive impacts may accumulate and contribute to CTE. Spurred by new knowledge of CTE and CTE's effect on players, the importance and effectiveness of helmet technology has become paramount to the health of sports players and others.

Several types of helmets have been used in the sport of football ever since players began wearing helmets. Early football helmets were made from hardened leather. Modern helmets are made from plastic and generally include a shock absorbing liner within a plastic shell, a face guard, and a chin strap that fits snugly on the chin of a player to secure the helmet to the player's head.

An example of a prior art device may be found in U.S. Patent Publication No. 2014/0000011, which discloses a helmet having cells filled with an attenuating fluid such as CO2, air, or water. An accelerometer on each cell may detect an impact and a microcontroller opens an exhaust valve on the cell, which allows the cell to discharge the attenuating fluid in an effort to absorb some of the impact. The cells must be pre-filled with the attenuating fluid. Therefore, a player must return to the sideline after each impact that triggers a release of attenuating fluid. This interruption can negatively affect the play of the game when players are routinely exiting and entering the field of play.

Another example of a prior art device may be found in U.S. Patent Publication No. 2012/0304367, which discloses a helmet with a protective bladder and relief valves. If the pressure in the bladder is greater than a threshold pressure, then the relief valve is opened to evacuate the contents of the bladder to help absorb an impact. However, there is no system or protocol for a post-impact inflation of the bladder. During a football game, a player may experience a first impact early in a play and then a second impact later in the play. If the bladder remains deflated for the second impact, then the player is at an increased risk of experiencing a concussive or sub-concussive impact that can contribute to CTE.

While the prior art may be adequate for its intended purposes, there is still a need for a protective helmet that provides better protection to reduce impact forces sustained by helmet wearers. There is also a need for a protective helmet that provides optimal brain protection for a wearer in which the protective helmet can be re-set or otherwise returned to a ready state by fluid bladders or reservoirs that deflate upon impact but are then automatically re-inflated after an initial impact.

SUMMARY OF THE INVENTION

In accordance with the invention, a protective helmet is provided that comprises a plurality of fluid bladders or reservoirs that absorb energy from an impact and a system for reinflating the bladders after the impact. Sensors can open and close valves on the bladders to expel fluid. Re-inflation of the bladders can be controlled after a predetermined amount of time elapses after the initial impact or once key pressure readings within the bladders rise or fall below a predetermined threshold pressure. Generally, the systems for reinflating the bladders can be open systems or closed systems. Open systems may expel fluid outside of the helmet to absorb an impact, and then draw in fluid from outside of the helmet to reinflate the bladders. Bladders in a closed system may also expel fluid during an impact, but the expelled fluid is captured by the system and used to reinflate the bladders of the protective helmet after the impact.

An open system for a protective helmet can incorporate one or more pumps to re-inflate the deflated bladder(s) in the protective helmet. In some embodiments, each bladder in the protective helmet may have its own corresponding pump. When a bladder experiences an impact, a triggering event causes a valve on the bladder to open and expel fluid outside of the bladder system to absorb the impact. This triggering event may be a pressure spike or an acceleration of the helmet and bladder beyond a predetermined threshold. After expulsion of the fluid, the pump re-inflates the deflated bladder to a pre-impact or fill pressure. In other embodiments, the bladders are interconnected to a single pump, which may be positioned in the helmet or remotely such as on the shoulder pads of a football player. The bladders may be arranged in series or in parallel with the pump.

A closed system for a protective helmet can incorporate a system of valves and reservoirs to store expelled fluid and reinflate a bladder. In some embodiments, the bladders are in fluid communication with a reservoir that defines a volume. During an impact, a bladder may expel fluid into the reservoir such that the pressure of the fluid in the reservoir increases and the pressure of the bladder decreases to absorb the impact. Once the impact has been absorbed, the reservoir may reintroduce the pressurized fluid back to the deflated bladder to return the bladder to its pre-impact or fill pressure. The reservoir may be arranged in many different configurations. For example, the reservoir may be a vessel positioned adjacent to the protective helmet or remotely, for example, in the shoulder pads of a football player. In other embodiments, the reservoir may be incorporated in the interstitial spaces between bladders or a space in a structural support band of the helmet. In yet further embodiments, the reservoir may be a pressure accumulator that has an interior bladder that helps store potential energy by compressing a second fluid. It will be appreciated that some embodiments of the invention can include aspects or components from both an open system and a closed system for a protective helmet.

Various embodiments of the protective helmet may actively manipulate valves and connections in response to a triggering event to better absorb an impact. For example, the plurality of bladders can be in fluid communication with each other such that a pressure change in one bladder is transmitted to at least one other bladder. Thus, the forces from an impact can be distributed across multiple bladders instead of a single bladder. In some aspects of the invention, a sensor for a given bladder may operably communicate with sensors on more than one bladder. Therefore, when a sensor detects a triggering event, the sensor can open valves on multiple bladders to quickly deflate the bladder absorbing the brunt of the impact.

In various aspects of the invention, the sensors may employ one of many different types of sensors configured to detect a triggering event or events. For instance, the sensor may be a pressure sensor configured to detect a pressure increase beyond a threshold or a pressure decrease below a threshold. The pressure sensor may also be configured to detect a rate change of pressure beyond a predetermined threshold. In another example, the sensor is an accelerometer that detects an acceleration of the bladder or protective helmet. Embodiments of the instant invention may interpret excessive acceleration of the bladder or helmet as an impact event, and thus, the sensor causes the valve on a bladder to open and release fluid to absorb the impact. The sensor can also detect a follow-up event or second triggering event and cause the valve to close. In various embodiments, the bladders maintain a minimum pressure to prevent a direct impact through a completely deflated bladder and to the head of a person who is wearing the protective helmet. The second triggering event may be, for example, a minimum pressure in the bladder or a delay period after the first triggering event. It will be appreciated that in some embodiments a separate controller may be used to route the logic considerations of the invention.

Bladders and other components of the invention may be made from a variety of materials and combinations of materials. The bladders can be made from high resistance polyvinyl chloride ("PVC"), polyester with PVC induction, acrylonitrile butadiene rubber, perbunan, butyl rubber, flouro rubber, Viton, ethylene oxide epichlorohydrin rubber, and other various elastomers. Various valves, sensors, and other components may be integrated into a bladder using high frequency soldering techniques. The fluids used in the bladder may include air, water, mineral oil, and/or hydrocarbons.

While use of the protective helmet described herein reduces the effects of an impact, most helmets currently used in sports do not have a bladder system. Therefore, it is desirable to retrofit existing helmets with a bladder system to incur the benefits associated with embodiments of the protective helmet described herein. Existing helmets often have a foam lining or foam inserts to help absorb an impact. These inserts may be removed, and a bladder system according to embodiments of the invention may be inserted into a shell of the helmet. In more extensive modifications, the helmet may be cut down to a structural support band that allows a facemask to attach to the helmet and allows bladders to absorb impacts without an intermediate shell. Other components such as a reservoir or a pump may also be positioned on the helmet or in another location on a person wearing the helmet. Therefore, a helmet retrofitted with embodiments of the invention may absorb an impact and then reinflate after the impact.

Considering the above described features and attributes, in one aspect of the invention, it can be considered a protective helmet, comprising (a) a structural support band defining a perimeter edge of the protective helmet; (b) a plurality of bladders interconnected to the structural support band, each bladder in the plurality of bladders having a volume configured to store a fluid; (c) a valve positioned on each bladder in the plurality of bladders, each valve is in fluid communication with the corresponding volume of each bladder in the plurality of bladders; (d) a sensor positioned on each bladder in the plurality bladders, each sensor is in operable communication with the corresponding valve of each bladder in the plurality of bladders, wherein each valve is configured to open and release at least some of the fluid stored in corresponding volume when the corresponding sensor detects a triggering event; and (e) a pump in fluid communication with the volumes of the plurality of bladders, the pump configured to increase the pressure of the fluid stored in the volumes of the plurality of bladders to a fill pressure after deflation of one or more bladders.

In another aspect of the invention, it can be considered a method for absorbing an impact to a protective helmet, comprising (a) providing a plurality of bladders interconnected to a structural support band that defines a perimeter edge of the protective helmet, each bladder in the plurality of bladders having a volume configured to store a fluid, a valve in fluid communication with the volume, and a sensor in operable communication with the valve; (b) providing a pump in fluid communication with the volumes of the plurality of bladders; (c) detecting, by one of the sensors, a triggering event and then opening the valve on the corresponding bladder to release at least some of the fluid stored in the volume of the corresponding bladder; (d) closing the opened valve when the sensor detects a second triggering event; (e) pumping, by the pump, fluid into the volumes of the plurality of bladders to a fill pressure after deflation of one or more bladders.

In some aspects, it can be considered a protective helmet, or a method for absorbing an impact to a protective helmet, wherein the plurality of bladders comprises a right front bladder, a right rear bladder, a left rear bladder, a left front bladder, a top left bladder, and a top right bladder. In addition, a pump may be positioned on each bladder in the plurality bladders; each pump is in operable communication with the corresponding sensor of each bladder in the plurality of bladders.

In various other aspects, it can also be considered a protective helmet, or a method for absorbing an impact to a protective helmet, further comprising a padding layer disposed on an inner surface of the plurality of bladders, the padding layer having an inner surface that is distinct from the inner surface of the plurality of bladders. In addition, it can be considered a protective helmet further comprising an indicator light positioned on an outer surface of the plurality of bladders, the indicator light configured to emit light after deflation of one or more bladders.

In yet other aspects, it can also be considered a protective helmet, or a method for absorbing an impact to a protective helmet, wherein the sensors are one of (i) pressure sensors configured to detect a triggering event that is a pressure increase beyond a predetermined pressure threshold; and (ii) accelerometers configured to detect a triggering event that is an acceleration beyond a predetermined acceleration threshold. Additionally, each valve may be configured to close when the corresponding sensor detects a second triggering event, wherein the second triggering event may be one of (i) a pressure decrease below a second predetermined pressure threshold; and (ii) a delay period after the first triggering event. The sensors may also be in operable communication with each other, wherein the sensor that detects the triggering event is configured to open more than one valve.

In some aspects, it can be further considered a protective helmet, or a method for absorbing an impact to a protective helmet, further comprising a plurality of fluid lines that provide fluid communication between bladders in the plurality of bladders such that a pressure change in one bladder is transmitted to at least one other bladder. In addition, a first check valve may be positioned in a first tube of each fluid line in the plurality of fluid lines, the first check valve oriented to allow fluid flow in a first direction; and a second check valve may be positioned in a second tube of each fluid line in the plurality of fluid lines, the second check valve oriented to allow fluid in a second direction. Further, the first check valve may have a first cracking pressure, and the second check valve may have a second cracking pressure, wherein the first cracking pressure is set to the fill pressure of the fluid in the volumes of the plurality of bladders.

In addition, it can be considered a protective helmet, or a method for absorbing an impact to a protective helmet, further comprising (i) a centralized controller operably interconnected to at least one sensor and at least one valve in the plurality of bladders, the controller configured to receive an input signal from the at least one sensor and transmit an output signal to the at least one valve, depending on a predetermined logic, and/or (ii) a decentralized controller positioned on each bladder in the plurality of bladders, each controller configured to receive an input signal from a corresponding sensor and transmit an output signal to a corresponding valve, depending on a predetermined logic.

Further advantages and features of the invention will become apparent from a review of the following detailed description, taken in conjunction with the drawings.

BRIEF DESCRIPTION OF THE DRAWINGS

Reference is now made to the following detailed description taken in conjunction with the accompanying drawings in order for a more thorough understanding of the invention.

DETAILED DESCRIPTION

Figure 1:
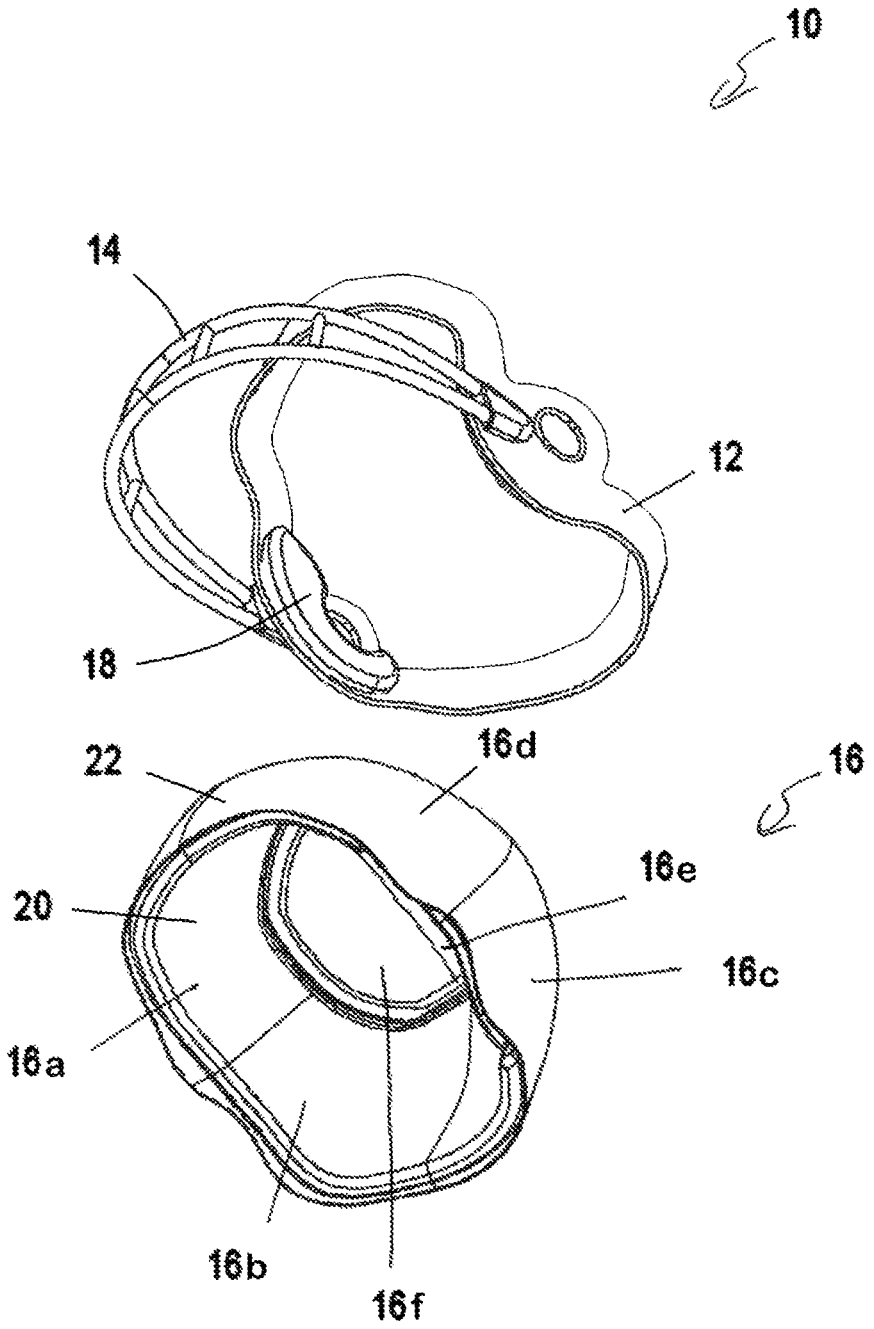
FIG. 1 is an exploded perspective view of a protective helmet having a system of six deflatable bladders interconnected to a structural support band.

Referring to FIG. 1, a protective helmet 10 is shown that incorporates a system of bladders 16 to absorb energy from an impact, such as a collision between players during a football game. The protective helmet 10 has a structural support band 12 which may be made from a plastic material to serve as support for attachment of a facemask 14 and the system of bladders 16. The structural support band 12 generally follows an edge perimeter of a traditional helmet while the system of bladders 16 supplements the structural support band 12 to cover the rest a person's head. In some embodiments, the structural support band 12 may include an ear hole, as shown in FIG. 1, and the facemask 14 is positioned at the front of the helmet 10 to prevent an object from reaching the face of a person. The facemask 14 may interconnect to a plurality of points on the helmet 10 including grommets (not shown) incorporated in the structural support band 12 of the helmet 10.

A system of bladders 16 is joined to the structural support band 12 to deflate and absorb energy from an impact. The system of bladders 16 in this embodiment comprises six bladders. A right front bladder 16*a* and a right rear bladder 16*b* protect the right side of a person's head, and a left rear bladder 16*c* and a left front bladder 16*d* protect the left side of a person's head. A left top bladder 16*e* and a right top bladder 16*f* protect the crown of a person's head. It will be appreciated that embodiments of the system of bladders 16 are not limited to a six-bladder configuration. For example, a protective helmet 10 may be outfitted with more than six bladders or fewer than six bladders, including a single continuous bladder.

The bladders 16 of the helmet 10 may be used in combination with other types of padding such as stiffened or hardened padding. For example, the helmet 10 may include ear padding 18, which can be stiffened padding or even deflatable bladders in some embodiments. In addition, the protective helmet 10 in FIG. 1 comprises an inner padding layer 20 between the system of bladders 16 and the person's head. The system of bladders 16 may not provide an ergonomic fit with the person's head since heads come in a wide range of shapes and sizes. A lack of ergonomic fit can cause the helmet 10 to move relative to a person's head and reduce the effectiveness of the protective helmet 10. Thus, in some embodiments, the inner padding layer 20 can provide a closer approximation to the shape of a person's head or in some instances the inner padding layer 20 can be custom fit to the person's precise head dimensions. The inner padding layer 20 may be made from a viscoelastic or low-resilience polyurethane foam. In other embodiments, a suspension system may be utilized where the system of bladders 16 is set off from the person's head by a predetermined distance and a series of straps interconnect the person's head to the system of bladders 16 and the protective helmet 10. Of course, it will be appreciated that embodiments of the protective helmet 10 may not include an inner padding layer 20 or strap system.

The outer surface of the protective helmet 10 in FIG. 1 comprises an outer layer 22. Team logos and other decals may be difficult to place on the material of the bladders 16. Therefore, an outer layer 22 can selectively interconnect to the structural support band 12 or the bladders 16 and cover the bladders 16. The outer layer 22 can be air permeable to allow valves and pumps on the bladders 16 to function and to prevent dirt and other debris from contacting the bladders 16. The outer layer 22 may also provide a lower coefficient of friction than the material of the bladders 16 to enhance slipping or sliding of the protective helmet, thereby lessening the energy of the impact to be more of a "glancing" blow, such as may be the case when there is contact with other helmets, other players, the ground, etc. This slipping aspect of the outer layer 22 can also reduce the rotation of the protective helmet during an impact, which reduces the likelihood of a concussion and trauma to the brain.

A series of openings or holes in the protective helmet 10 can aid in the ventilation of heat from a person's head to the ambient environment. The interconnection or selective interconnection between bladders 16 may set the bladders 16 apart from each other by a predetermined distance. Thus, the gaps in the interstitial spaces between the bladders 16 allow heat to vent away from a person's head. In various embodiments, the bladders 16 themselves may comprise openings or holes to ventilate heat. For example, a bladder 16 may have a central aperture such that the bladder 16 is substantially shaped like a ring. In some embodiments, the structural support band 12 may comprise an open, lattice-like structure to provide the necessary functionality described above and to provide enhanced heat transfer properties to the protective helmet 10. Similarly, the outer layer 22 may comprise openings or holes to facilitate heat transfer from a person's head to the ambient environment.

Figure 2:
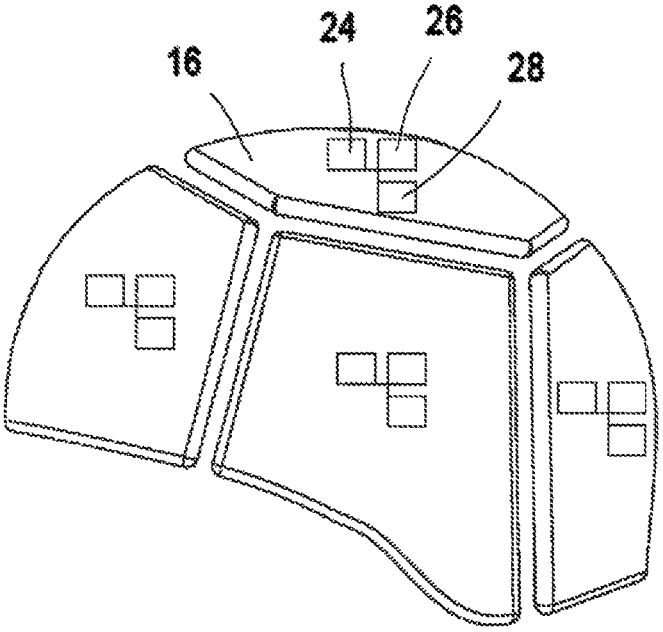
FIG. 2 is a side view of an open system of bladders where each bladder has a sensor, a valve, and a pump.

Referring to FIG. 2, an open system of bladders is provided where each bladder 16 has a sensor 24 and a valve 26 configured to expel fluid during an impact and a pump 28 to reinflate the bladder 16 after the impact. The system of bladders 16 is open to an external source of fluid, which in some embodiments may simply be ambient air. For example, after a bladder 16 expels fluid from a valve 26, the pump 28 draws in ambient air to reinflate the bladder 16.

The valve 26 is configured to open and expel fluid when the sensor 24 detects a triggering event. This event may be a pressure spike or an acceleration of the helmet 10 or bladder 16, and thus, the sensor 24 may be a pressure sensor or an accelerometer. After opening, the valve 26 may close again to prevent a complete deflation of the bladder 16. A complete loss of pressure in the system of bladders 16 would allow direct impacts to a person's head. The valve 26 may close when the sensor 24 detects a second triggering event such as a pressure drop below a predetermined threshold or a delay period. For example, the valve 26 may automatically close 1 second after the first or initial triggering event to prevent further expulsion of fluid. In view of the first and second triggering events, an optimal pressure range may be established. In some embodiments, the pressure range may be between 20 psi and 40 psi. As such, the valve 26 would open when the pressure exceeds 40 psi, and close when the pressure falls below 20 psi. Then, the pump 28 would reinflate the bladder to an intermediate fill pressure, for example, 30 psi.

Figure 3A:
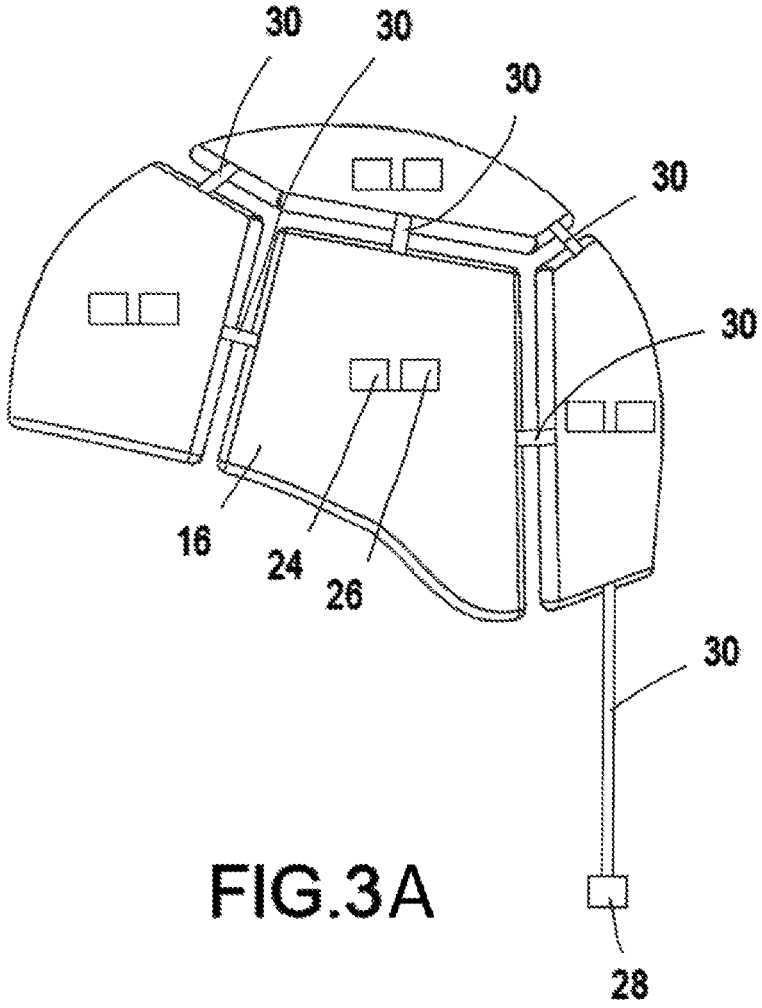
FIG. 3A is a side view of another open system of bladders where each bladder has a sensor and a valve, and the bladders are each in fluid communication with a remote pump.

Referring to FIG. 3A, an open system of bladders is provided where each bladder 16 has a sensor 24 and a valve 26 configured to expel fluid during an impact. A series of fluid lines 30 interconnect the bladders 16 to each other to help disperse an impact. An additional fluid line 30 interconnects a remote pump 28 to one of the bladders 16. When one or more bladders 16 expels fluid to absorb an impact, the pump 28 supplies fluid to the system of bladders 16 to reinflate the one or more bladders 16 after the impact.

A further aspect of some embodiments is the ability for bladders 16 and components on the bladders 16 to be in electronic communication with each other, which allows a holistic and coordinated response to an impact to improve the effectiveness of the helmet 10. For instance, a bladder 16 on the right side of a person's head may experience an impact, but only the valve 26 on this bladder opens and expels fluid. As a result, some fluid in the bladder 16 may compress and exit through a fluid line 30 and then compress fluid in another bladder 16. This series of compressions takes time and creates backpressure for the bladder 16 absorbing the impact. Thus, the single valve 26 expelling fluid can be a choke point, and the bladder 16 may deflate too slowly to properly absorb the impact.

The electronic communication between bladders 16, sensors 24, and valves 26 allows for valves on multiple bladders 16 to open and expel fluid. Referring to the previous example, when the right bladder 16 is experiencing an impact, the sensor 24 on this bladder 16 communicates a triggering event to valves 26 on other bladders 16. Therefore, valves 26 may open an expel fluid from bladders 16 that are not experiencing the brunt of an impact, which allows the bladder 16 that is experiencing the brunt of the impact to expel fluid more quickly and without backpressure issues.

Figure 3B:
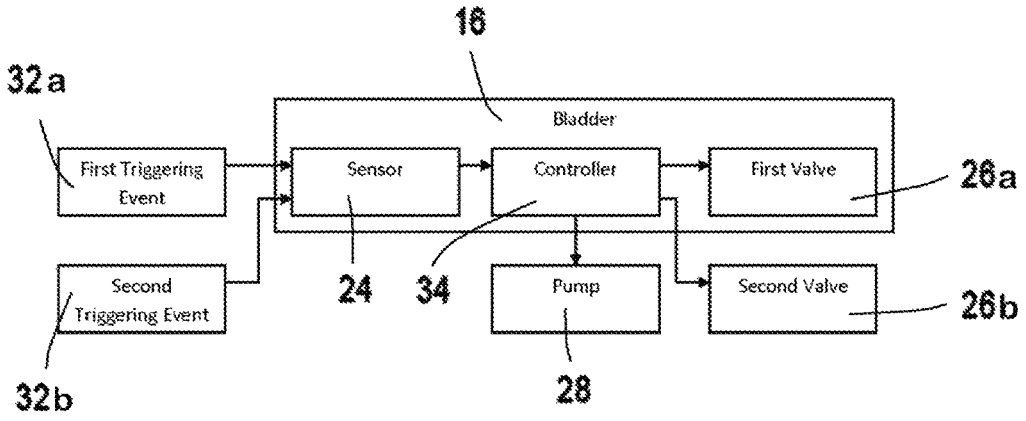
FIG. 3B is a schematic block diagram illustrating the electronic communication between a sensor, a controller, valves, and a pump in response to multiple triggering events.

Next, referring to FIG. 3B, a schematic diagram is provided showing the electronic communication between the sensor 24, a controller 34, valves 26, and the pump 28 in response to multiple triggering events 32*a*, 32*b*. The controller 34 serves as an automatic data processor to run algorithms and predetermined logic that control the state of the valves (open/closed) and the pump (on/off). The controller 34 may be connected to an electric power source so that the controller 34 can operate, which includes transmitting output signals to other components. It will be appreciated that the functions of the controller 34 described herein may be integrated into other components, for example, the sensor 24.

The sensor 24 on the bladder 16 detects a first triggering event 32*a*, and the sensor 24 transmits an input signal to the controller 34. The controller 34 receives the input signal and orchestrates the proper response to the first triggering event 32*a* with various predetermined logic considerations. A logic consideration with respect to the first triggering event 32*a* may be the pressure reading of the bladder 16 above a threshold, and another logic consideration may be the acceleration of the helmet and bladder 16 above a threshold. If the proper logic consideration is satisfied, the controller 34 transmits an output signal to the first valve 26*a*, causing the valve 26*a* to open and expel fluid from the bladder 16. Further, as described with respect to FIG. 3A, the controller 34 also may send an output signal to a second valve 26 to open and expel fluid from another bladder. The logic considerations and thresholds may be adjustable and/or preprogrammable. For instance, a "youth setting" may have lower pressure spike or acceleration thresholds for expelling fluid while "high school," "college," and "professional" settings can have higher thresholds for expelling fluid.

Then, the controller 34 dictates how to reinflate the depleted bladder 16 with the pump 28. One logic consideration is that the controller 34 simply transmits an output signal to the pump 28 to begin pumping after a time delay from the first triggering event 32*a*. Another logic consideration is that the controller 34 transmits an output signal to the pump 28 to begin pumping based upon a reading from the sensor 24. The reading may be a pressure threshold, for example, a minimum pressure to prevent direct impact to the head of the person wearing the protective helmet. Further embodiments of the present invention may combine various logic considerations and even organize logic considerations into a hierarchy. For example, a small pressure spike results in a quick opening of a valve to expel a small amount of fluid, but a large pressure spike will cause the valve to remain open until a minimum pressure is reached, then the valve will close.

It will be appreciated that a controller 34 can be centralized to control more than one bladder, sensor, and/or valve, but a controller 34 may also be decentralized. For example, each bladder may have a controller 34 such that the bladders are modular and operate independently of each other. Therefore, a controller 34 may receive an input signal from a sensor on a bladder and, depending on the particular logic consideration, transmit an output signal to a valve on the bladder to control the state of the valve. With the modular, decentralized embodiments, a defective bladder system may be replaced without interrupting the operation of other bladders and bladder systems in the protective helmet 10.

Figure 4:
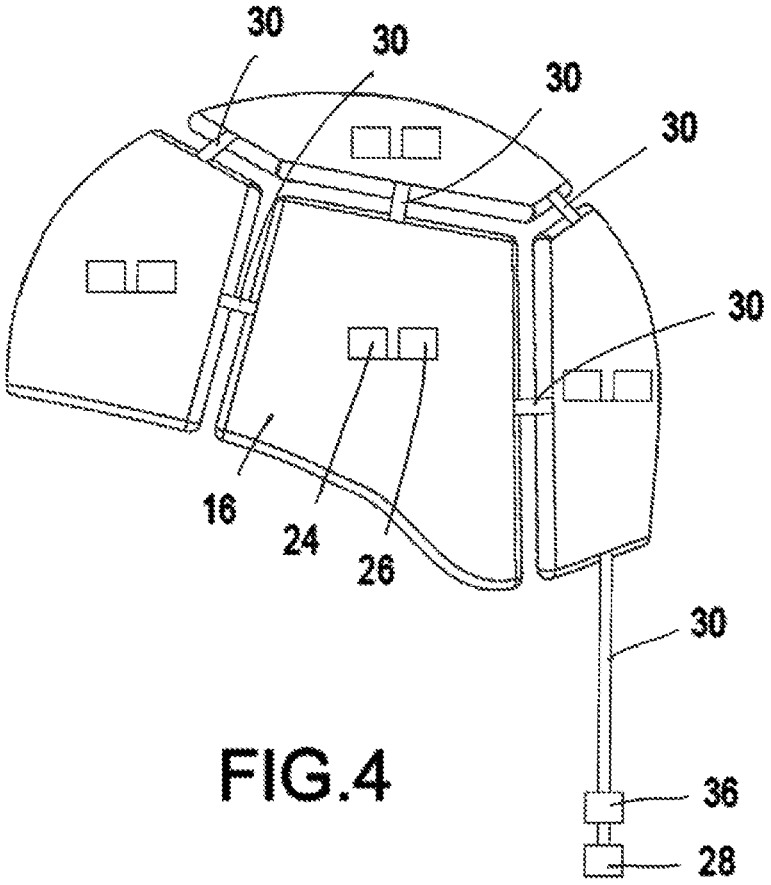
FIG. 4 is a side view of another open system of bladders where each bladder has a sensor and a valve, and the bladders are each in fluid communication with a remote reservoir and a remote pump.

Referring to FIG. 4, an open system of bladders 16 is provided similar to the system of FIG. 3A, but a remote reservoir 36 is incorporated into the protective helmet 10 to alter the reinflation characteristics of the helmet. The reservoir 36 is positioned on the fluid line 30 that interconnects the pump 28 to the system of bladders 16. The reservoir 36 may be a vessel defining a volume that can store and release a pressurized fluid. In one example, the pump 28 begins charging the reservoir 36 with pressurized fluid as soon as one of the sensors 24 detects a triggering event such as a pressure spike or an acceleration of the helmet beyond a predetermined threshold. After a charging period, the reservoir 36 dumps the pressurized fluid into the system of bladders 16 to reinflate the bladders 16. The charging period allows the pump 28 to immediately begin accumulating pressurized fluid in the reservoir 36 during an impact without adding backpressure to the system of bladders 16 and interfering with the ability of the bladders 16 to expel fluid. The charging period, the volume of the reservoir 36, the number of reservoirs 36, the configuration of reservoirs 36, etc. may be altered to adjust the reinflation characteristics of the system of bladders 16 of the protective helmet 10. It will be further appreciated that instead of a charging period, for example, a pressure reading from one or more bladders can be used to control when the pump 28 begins pressurizing fluid, and when the reservoir 36 subsequently discharges pressurized fluid.

Figure 5:
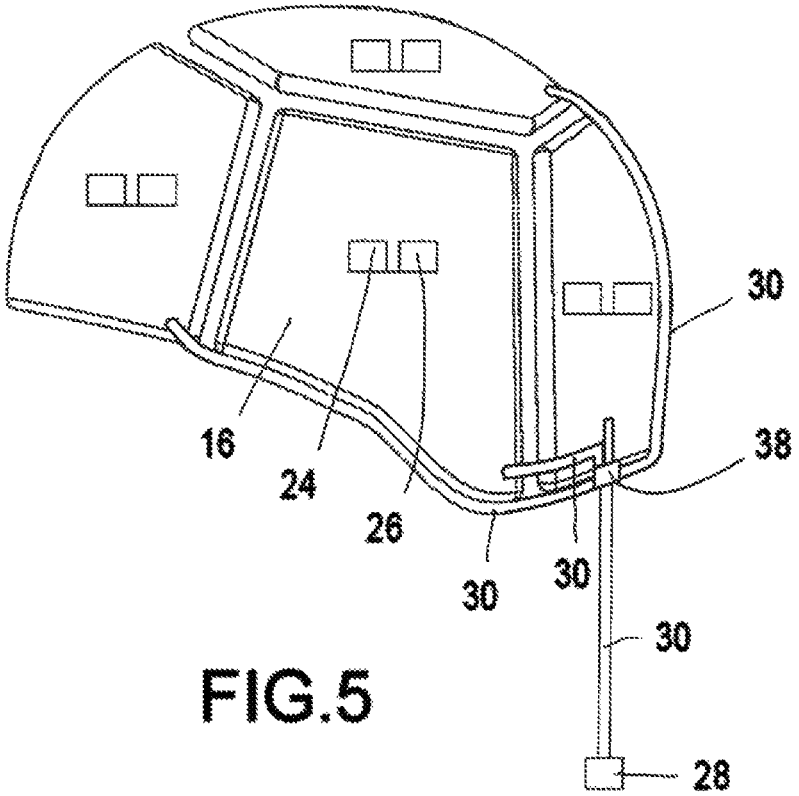
FIG. 5 is a side view of another open system of bladders where each bladder has a sensor and a valve, and the bladders are connected in series to a remote pump.

Referring to FIG. 5, an open system of bladders 16 is provided where each bladder 16 is serially interconnected to the pump 28. Specifically, a fluid line 30 from each bladder 16 extends to a distributor 38, which is then interconnected to the pump 28 via another fluid line 30. The distributor 38 can store pressurized fluid like a reservoir and/or selectively control fluid communication from the pump 28 to each of the bladders. The serial interconnection of the bladders in FIG. 5 is in contrast to the generally parallel interconnection of the bladders in FIGS. 3A and 4 to the pump 28. The various types of interconnections can provide different reinflation characteristics for the system of bladders 16 of the protective helmet 10.

Figure 6:
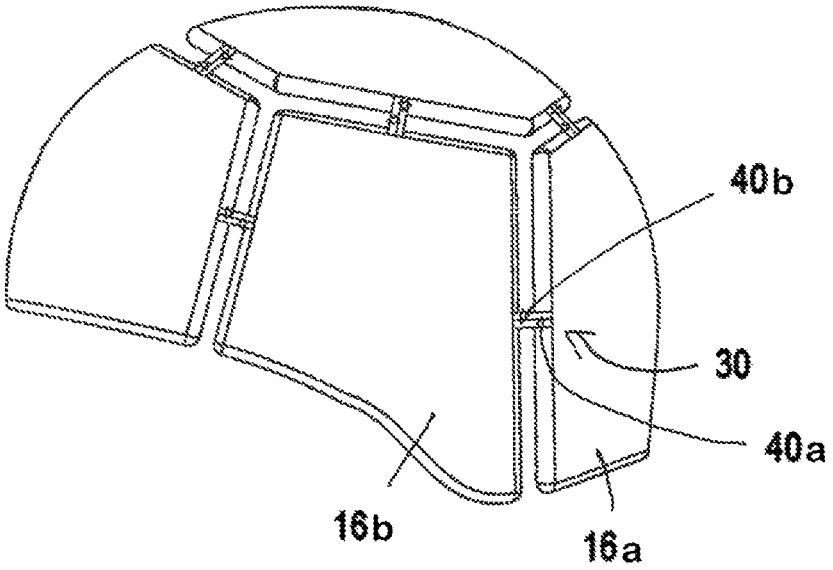
FIG. 6 is a side view of a closed system of bladders where check valves interconnect the bladders to each other.

Referring to FIG. 6, a closed system of bladders 16 is provided where fluid lines 30 interconnect the bladders 16 to each other. The system of bladders 16 is closed to external sources of fluid and thus relies on a fixed volume of fluid to absorb an impact. In this embodiment, each fluid line 30 has first and second tubes, and a check valve is positioned in each tube. In a given fluid line 30, first and second check valves 40*a*, 40*b* are oriented in opposite directions. Thus, when a bladder 16 is absorbing an impact, fluid only flows out of the bladder 16 and into other bladders 16 to help mitigate against backpressure issues. After the impact has been absorbed, the other bladders 16 reinflate the bladder 16 that absorbed the impact.

Figure 7:
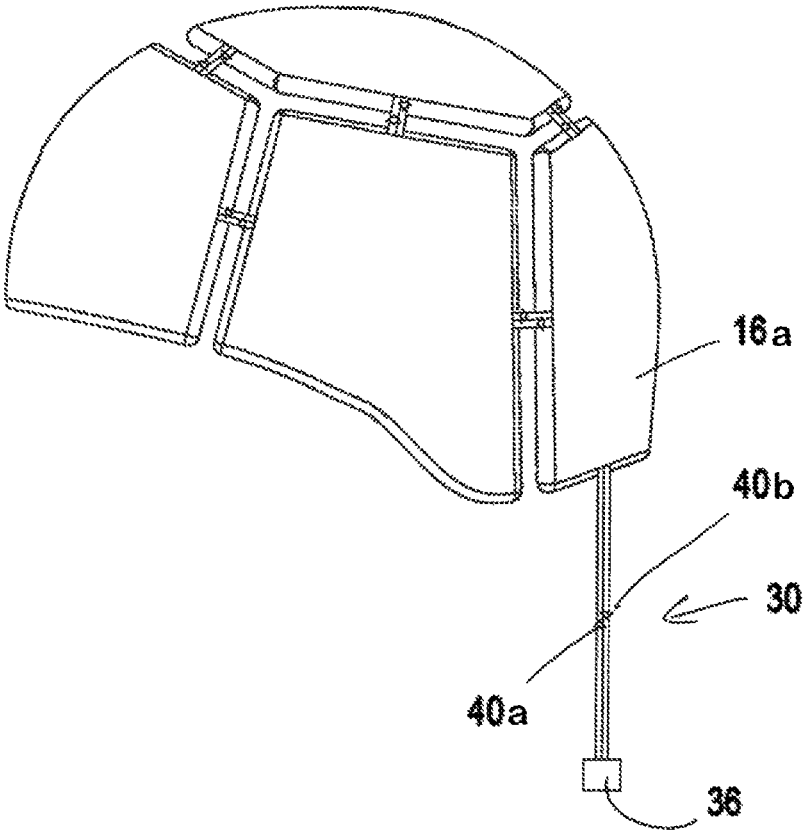
FIG. 7 is a side view of a closed system of bladders where check valves interconnect the bladders to each other and to a remote reservoir.

Referring to FIG. 7, a closed system of bladders 16 is shown that is similar to the embodiment in FIG. 6. However, the embodiment in FIG. 7 comprises an addition fluid line 30 with tubes and check valves 40*a*, 40*b* that leads to a reservoir 36. This embodiment also operates like the embodiment in FIG. 6 except that a reservoir 36 is now available to receive pressurized fluid from a bladder 16 absorbing an impact. The bladders 16 are generally interconnected in parallel with the reservoir 36. Other embodiments may have other configurations such as a serial interconnection with a distributor as discussed elsewhere herein.

Figure 8:
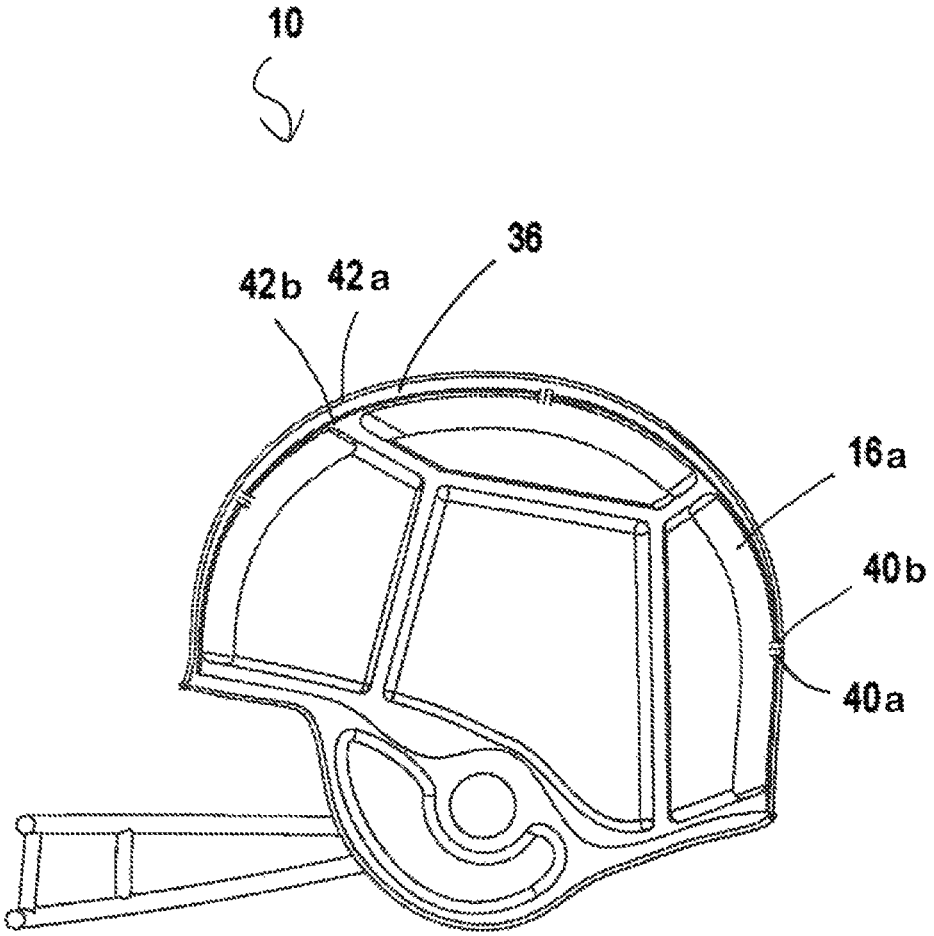
FIG. 8 is a cross-sectional view of a protective helmet where check valves interconnect a system of bladders to a reservoir positioned between an inner shell and an outer shell of the protective helmet.

Referring to FIG. 8, a cross sectional view of a closed system of bladders 16 is provided where the shell of the helmet 10 comprises an outer shell 42*a* and an inner shell 42*b*. The hermetically sealed volume between the shells 42*a*, 42*b* functions as a reservoir 36 in this embodiment. Oppositely oriented check valves 40*a*, 40*b* individually interconnect each bladder 16 to the reservoir 36. Thus, when a bladder 16 absorbs an impact, the bladder 16 expels fluid into the reservoir 36. After the impact is absorbed, the now-pressurized reservoir reinflates the bladder 16.

It will be appreciated that in other embodiments, the reservoir 36 is positioned in the structural support band defining the perimeter edge of the protective helmet 10. The structural support band may have an enclosed volume that serves as a reservoir 36 and is interconnected to the bladders with fluid lines and/or check valves. When the bladders absorb an impact, pressurized fluid is stored in the reservoir 36 in the structural support band.

While the above description and drawings disclose and illustrate embodiments of the invention, it should be understood that the invention is not limited to these embodiments. It will be appreciated that other modifications and changes employing the principles of the invention, particularly considering the foregoing teachings, may be made. Therefore, by the appended claims, the applicant intends to cover such modifications and other embodiments.

What is claimed is:

1. A protective helmet, comprising:

a structural support band defining a perimeter edge of the protective helmet;

a plurality of bladders interconnected to the structural support band, each bladder in the plurality of bladders having a volume configured to store fluid;

a valve positioned on each bladder in the plurality of bladders, each valve being in fluid communication with the corresponding volume of each bladder in the plurality of bladders;

a sensor positioned on each bladder in the plurality bladders, each sensor being in operable communication with the corresponding valve of each bladder in the plurality of bladders, wherein each valve is configured to open and release at least some of the fluid stored in the corresponding volume when the corresponding sensor detects a triggering event; and at least one pump in fluid communication with the volumes of the plurality of bladders, the at least one pump configured to increase the pressure of the fluid stored in the volumes of the plurality of bladders to a fill pressure after deflation of one or more bladders; and wherein a plurality of fluid lines that provide fluid communication between bladders in the plurality of bladders such that a pressure change in one bladder is transmitted to at least one other bladder.

2. The protective helmet of claim 1, wherein:

the sensors are one of:

pressure sensors configured to detect a triggering event that is a pressure increase beyond a predetermined pressure threshold; or accelerometers configured to detect a triggering event defined as an acceleration exceeding a predetermined acceleration threshold.

3. The protective helmet of claim 1, wherein:

each valve is configured to close when the corresponding sensor detects a second triggering event, wherein the second triggering event is one of:

a pressure decrease below a second predetermined pressure threshold; or a delay period after the first triggering event.

4. The protective helmet of claim 1, further comprising:

a centralized controller operably interconnected to at least one sensor and at least one valve in the plurality of bladders, the controller configured to receive an input signal from the at least one sensor and transmit an output signal to the at least one valve, depending on a predetermined logic.

5. The protective helmet of claim 1, further comprising:

a decentralized controller positioned on each bladder in the plurality of bladders, each controller configured to receive an input signal from a corresponding sensor and transmit an output signal to a corresponding valve, depending on a predetermined logic.

6. The protective helmet of claim 1, wherein:

the sensors are in operable communication with each other, wherein the sensor that detects the triggering event is configured to open more than one valve.

7. The protective helmet of claim 1, further comprising:

a first check valve positioned in a first tube of each fluid line in the plurality of fluid lines, the first check valve oriented to allow fluid flow in a first direction; and a second check valve positioned in a second tube of each fluid line in the plurality of fluid lines, the second check valve oriented to allow fluid in a second direction.

8. The protective helmet of claim 7, wherein:

the first check valve has a first cracking pressure, and the second check valve has a second cracking pressure, wherein the first cracking pressure is set to the fill pressure of the fluid in the volumes of the plurality of bladders.

9. The protective helmet of claim 1, further comprising:

an indicator light positioned on an outer surface of the plurality of bladders, the indicator light configured to emit light after deflation of one or more bladders.

10. The protective helmet of claim 1, wherein:

the plurality of bladders comprises a right front bladder, a right rear bladder, a left rear bladder, a left front bladder, a top left bladder, and a top right bladder.

11. The protective helmet of claim 5, wherein:

the predetermined logic includes at least one of:

a) activation to open a valve based on detected pressure of a sensor being above a predetermined threshold;

b) activation to open a valve based on detected acceleration of the helmet above a predetermined threshold; or c) a selected combination of a) and b).

12. A protective helmet, comprising:

a structural support band defining a perimeter edge of the protective helmet;

a plurality of bladders interconnected to the structural support band, each bladder in the plurality of bladders having a volume configured to store fluid;

a valve positioned on each bladder in the plurality of bladders, each valve being in fluid communication with the corresponding volume of each bladder in the plurality of bladders;

a sensor positioned on each bladder in the plurality bladders, each sensor being in operable communication with the corresponding valve of each bladder in the plurality of bladders, wherein each valve is configured to open and release at least some of the fluid stored in the corresponding volume when the corresponding sensor detects a triggering event; and at least one pump in fluid communication with the volumes of the plurality of bladders, the at least one pump configured to increase the pressure of the fluid stored in the volumes of the plurality of bladders to a fill pressure after deflation of one or more bladders; and wherein the at least one pump is an individual pump positioned on each bladder in the plurality bladders, each individual pump being in operable communication with the corresponding sensor of each bladder in the plurality of bladders.

13. A protective helmet, comprising:

a structural support band defining a perimeter edge of the protective helmet;

a plurality of bladders interconnected to the structural support band, each bladder in the plurality of bladders having a volume configured to store fluid;

a valve positioned on each bladder in the plurality of bladders, each valve being in fluid communication with the corresponding volume of each bladder in the plurality of bladders;

a sensor positioned on each bladder in the plurality bladders, each sensor being in operable communication with the corresponding valve of each bladder in the plurality of bladders, wherein each valve is configured to open and release at least some of the fluid stored in the corresponding volume when the corresponding sensor detects a triggering event; and at least one pump in fluid communication with the volumes of the plurality of bladders, the at least one pump configured to increase the pressure of the fluid stored in the volumes of the plurality of bladders to a fill pressure after deflation of one or more bladders; and wherein a padding layer disposed on an inner surface of the plurality of bladders, the padding layer having an inner surface that is distinct from the inner surface of the plurality of bladders.

* * * * *